US007437250B2

(12) United States Patent
Breen et al.

(10) Patent No.: US 7,437,250 B2
(45) Date of Patent: Oct. 14, 2008

(54) AIRPORT PAVEMENT MANAGEMENT SYSTEM

(75) Inventors: Thomas J. Breen, Tyngsboro, MA (US); Alexander E. Smith, McLean, VA (US)

(73) Assignee: ERA Systems Corporation, Reston, VA (US)

( * ) Notice: Subject to any disclaimer, the term of this patent is extended or adjusted under 35 U.S.C. 154(b) by 0 days.

(21) Appl. No.: 11/145,170

(22) Filed: Jun. 6, 2005

(65) Prior Publication Data

US 2006/0036378 A1 Feb. 16, 2006

Related U.S. Application Data

(60) Continuation-in-part of application No. 10/743,042, filed on Dec. 23, 2003, now Pat. No. 7,132,982, which is a continuation-in-part of application No. 10/638,524, filed on Aug. 12, 2003, now Pat. No. 6,806,829, which is a continuation of application No. 09/516,215, filed on Feb. 29, 2000, now Pat. No. 6,633,259, said application No. 10/743,042 is a continuation-in-part of application No. 10/319,725, filed on Dec. 16, 2002, now Pat. No. 6,812,890, and a continuation-in-part of application No. 10/457,439, filed on Jun. 10, 2003, now Pat. No. 6,885,340, application No. 11/145,170, which is a continuation-in-part of application No. 11/031,457, filed on Jan. 7, 2005, which is a continuation-in-part of application No. 10/638,524, which is a continuation of application No. 09/516,215, said application No. 11/031,457 is a continuation-in-part of application No. 10/319,725, and a continuation-in-part of application No. 10/457,439, application No. 11/145,170, which is a continuation-in-part of application No. 10/756,799, filed on Jan. 14, 2004, now Pat. No. 7,126,534, which is a continuation-in-part of application No. 10/638,524, which is a continuation of application No. 09/516,215, and a continuation-in-part of application No. 10/319,725, and a continuation-in-part of application No. 10/457,439, and a continuation-in-part of application No. 10/751,115, filed on Jan. 5, 2004, now Pat. No. 6,992,626, and a continuation-in-part of application No. 10/743,042, application No. 11/145,170, which is a continuation-in-part of application No. 10/830,444, filed on Apr. 23, 2004, now Pat. No. 7,123,192, which is a division of application No. 10/457,439, which is a continuation-in-part of application No. 09/516,215, and a continuation-in-part of application No. 10/319,725, application No. 11/145,170, which is a continuation-in-part of application No. 11/111,957, filed on Apr. 22, 2005, now abandoned.

(60) Provisional application No. 60/123,170, filed on Mar. 5, 1999, provisional application No. 60/343,237, filed on Dec. 31, 2001, provisional application No. 60/440,618, filed on Jan. 17, 2003, provisional application No. 60/534,706, filed on Jan. 8, 2004.

(51) Int. Cl.
*G01B 3/44* (2006.01)
*E01C 7/00* (2006.01)

(52) U.S. Cl. ..... 702/34; 404/17

(58) Field of Classification Search ..... 702/34–36, 702/173, 167, 130, 141–142, 144, 138, 81; 342/36–37; 340/958, 971–973; 404/17, 404/71–72

See application file for complete search history.

(56) References Cited

U.S. PATENT DOCUMENTS

| | | | | |
|---|---|---|---|---|
| 1,738,571 | A * | 12/1929 | Gare | 404/18 |
| 3,668,403 | A | 6/1972 | Meilander | 701/121 |
| 3,705,404 | A | 12/1972 | Chisholm | 343/112 R |
| 3,792,472 | A | 2/1974 | Payne et al. | 342/32 |
| 4,079,414 | A | 3/1978 | Sullivan | 725/114 |
| 4,122,522 | A | 10/1978 | Smith | 701/15 |
| 4,167,006 | A | 9/1979 | Funatsu et al. | 343/6.5 LC |
| 4,196,474 | A | 4/1980 | Buchanan et al. | 364/461 |
| 4,224,669 | A | 9/1980 | Brame | 701/8 |
| 4,229,737 | A | 10/1980 | Heldwein et al. | 343/6 R |

| | | | | |
|---|---|---|---|---|
| 4,293,857 | A | 10/1981 | Baldwin | 343/6.5 |
| 4,327,437 | A | 4/1982 | Frosch et al. | 714/3 |
| 4,359,733 | A | 11/1982 | O'Neill | 342/36 |
| 4,454,510 | A | 6/1984 | Crow | 343/5 |
| 4,524,931 | A | 6/1985 | Nilsson | 246/167 |
| 4,646,244 | A | 2/1987 | Bateman | 701/301 |
| 4,688,046 | A | 8/1987 | Schwab | 342/456 |
| 4,782,450 | A | 11/1988 | Flax | 364/461 |
| 4,811,308 | A | 3/1989 | Michel | 367/136 |
| 4,899,296 | A * | 2/1990 | Khattak | 702/40 |
| 4,914,733 | A | 4/1990 | Gralnick | 340/961 |
| 4,958,306 | A * | 9/1990 | Powell et al. | 702/40 |
| 5,075,694 | A | 12/1991 | Donnangelo et al. | 342/455 |
| 5,144,315 | A | 9/1992 | Schwab et al. | 342/49 |
| 5,153,836 | A | 10/1992 | Fraughton et al. | 364/461 |
| 5,191,342 | A | 3/1993 | Alsup et al. | 342/465 |
| 5,260,702 | A | 11/1993 | Thompson | 340/970 |
| 5,262,784 | A | 11/1993 | Drobnicki et al. | 342/45 |
| 5,268,698 | A | 12/1993 | Smith et al. | 342/450 |
| 5,283,574 | A | 2/1994 | Grove | 340/970 |
| 5,317,316 | A | 5/1994 | Sturm et al. | 342/30 |
| 5,365,516 | A | 11/1994 | Jandrell | 370/18 |
| 5,374,932 | A | 12/1994 | Wyschogrod et al. | 342/36 |
| 5,381,140 | A | 1/1995 | Kuroda et al. | 340/961 |
| 5,402,116 | A | 3/1995 | Ashley | 340/870.1 |
| 5,454,720 | A | 10/1995 | FitzGerald et al. | 434/27 |
| 5,506,590 | A | 4/1996 | Minter | 342/462 |
| 5,528,244 | A | 6/1996 | Schwab | 342/37 |
| 5,570,095 | A | 10/1996 | Drouilhet, Jr. et al. | 342/357 |
| 5,596,326 | A | 1/1997 | Fitts | 342/30 |
| 5,596,332 | A | 1/1997 | Coles et al. | 342/455 |
| 5,617,101 | A | 4/1997 | Maine et al. | 342/358 |
| 5,627,546 | A | 5/1997 | Crow | 342/352 |
| 5,629,691 | A | 5/1997 | Jain | 340/961 |
| 5,666,110 | A | 9/1997 | Paterson | 340/970 |
| 5,680,140 | A | 10/1997 | Loomis | 342/357 |
| 5,714,948 | A | 2/1998 | Farmakis et al. | 340/961 |
| 5,752,216 | A | 5/1998 | Carlson et al. | 701/120 |
| 5,774,829 | A | 6/1998 | Cisneros et al. | 701/213 |
| 5,781,150 | A | 7/1998 | Norris | 342/357 |
| 5,798,712 | A | 8/1998 | Coquin | 340/970 |
| 5,839,080 | A | 11/1998 | Muller | 701/9 |
| 5,867,804 | A | 2/1999 | Pilley et al. | 701/120 |
| 5,884,222 | A | 3/1999 | Denoize et al. | 701/301 |
| 5,890,068 | A | 3/1999 | Fattouce et al. | 455/456.2 |
| 5,999,116 | A | 12/1999 | Evers | 342/36 |
| 6,049,304 | A | 4/2000 | Rudel et al. | 342/357.08 |
| 6,085,150 | A | 7/2000 | Henry et al. | 701/301 |
| 6,088,634 | A | 7/2000 | Muller | 701/9 |
| 6,092,009 | A | 7/2000 | Glover | 701/14 |
| 6,094,169 | A | 7/2000 | Smith et al. | 342/465 |
| 6,122,570 | A | 9/2000 | Muller | 701/9 |
| 6,127,944 | A | 10/2000 | Daly | 340/963 |
| 6,133,867 | A | 10/2000 | Eberwine et al. | 342/29 |
| 6,138,060 | A | 10/2000 | Conner | 701/9 |
| 6,201,499 | B1 | 3/2001 | Hawkes et al. | 342/387 |
| 6,208,284 | B1 | 3/2001 | Woodell et al. | 342/30 |
| 6,211,811 | B1 | 4/2001 | Evers | 342/36 |
| 6,219,592 | B1 | 4/2001 | Muller et al. | 701/9 |
| 6,292,721 | B1 | 9/2001 | Conner et al. | 701/9 |
| 6,311,127 | B1 | 10/2001 | Stratton et al. | 701/213 |
| 6,314,363 | B1 | 11/2001 | Pilley et al. | 701/120 |
| 6,327,471 | B1 | 12/2001 | Song | 455/440 |
| 6,347,263 | B1 | 2/2002 | Johnson et al. | 701/14 |
| 6,380,870 | B1 | 4/2002 | Conner et al. | 340/970 |
| 6,384,783 | B1 | 5/2002 | Smith et al. | 342/387 |
| 6,445,310 | B1 | 9/2002 | Bateman et al. | 340/970 |
| 6,448,929 | B1 | 9/2002 | Smith et al. | 342/456 |
| 6,463,383 | B1 | 10/2002 | Baiada et al. | 701/120 |
| 6,469,664 | B1 | 10/2002 | Michaelson et al. | 342/357.13 |
| 6,477,449 | B1 | 11/2002 | Conner et al. | 701/4 |
| 6,567,043 | B2 | 5/2003 | Smith et al. | 342/450 |
| 6,571,155 | B2 | 5/2003 | Carriker et al. | 701/3 |
| 6,584,414 | B1 * | 6/2003 | Green et al. | 702/33 |
| 6,606,034 | B1 | 8/2003 | Muller et al. | 340/970 |
| 6,615,648 | B1 * | 9/2003 | Ferguson et al. | 73/146 |
| 6,633,259 | B1 | 10/2003 | Smith et al. | 342/456 |
| 6,691,004 | B2 | 2/2004 | Johnson | 701/14 |
| 6,707,394 | B2 | 3/2004 | Ishihara | 340/970 |
| 6,710,723 | B2 | 3/2004 | Muller | 340/970 |
| 6,750,815 | B2 | 6/2004 | Michaelson et al. | 342/357.13 |
| 6,789,011 | B2 | 9/2004 | Baiada et al. | 701/120 |
| 6,812,890 | B2 | 11/2004 | Smith et al. | 342/454 |
| 6,873,903 | B2 | 3/2005 | Baiada et al. | 701/120 |
| 6,885,340 | B2 | 4/2005 | Smith et al. | 342/465 |
| 6,927,701 | B2 | 8/2005 | Schmidt et al. | 340/959 |
| 6,930,638 | B2 | 8/2005 | Lloyd et al. | 342/453 |
| 6,992,626 | B2 | 1/2006 | Smith | 342/454 |
| 7,123,169 | B2 | 10/2006 | Farmer et al. | 340/945 |
| 7,123,192 | B2 | 10/2006 | Smith et al. | 342/455 |
| 7,126,534 | B2 | 10/2006 | Smith et al. | 342/456 |
| 7,142,154 | B2 | 11/2006 | Quilter et al. | 342/357.06 |
| 2001/0026240 | A1 | 10/2001 | Neher | 342/357.07 |
| 2002/0021247 | A1 | 2/2002 | Smith et al. | 342/450 |
| 2002/0089433 | A1 | 7/2002 | Bateman et al. | 340/970 |
| 2003/0009267 | A1 | 1/2003 | Dunsky et al. | 701/4 |
| 2003/0097216 | A1 | 5/2003 | Etnyre | 701/120 |
| 2004/0004554 | A1 * | 1/2004 | Srinivasan et al. | 340/870.01 |
| 2004/0044463 | A1 | 3/2004 | Shing-Feng et al. | 701/120 |
| 2004/0086121 | A1 | 5/2004 | Viggiano et al. | 380/255 |
| 2004/0225432 | A1 | 11/2004 | Pilley et al. | 701/117 |
| 2005/0021283 | A1 | 1/2005 | Brinton et al. | 702/150 |
| 2005/0046569 | A1 | 3/2005 | Spriggs et al. | 340/551 |
| 2006/0119515 | A1 | 6/2006 | Smisth | 342/450 |
| 2006/0191326 | A1 | 8/2006 | Smith et al. | 73/73 |
| 2006/0276201 | A1 | 12/2006 | Dupray | 455/456.1 |
| 2007/0001903 | A1 | 1/2007 | Smith et al. | 342/387 |
| 2007/0159378 | A1 | 7/2007 | Powers et al. | 342/29 |

FOREIGN PATENT DOCUMENTS

| | | | |
|---|---|---|---|
| JP | 9-288175 | A | 11/1994 |
| JP | 6-342061 | A | 12/1994 |
| JP | 8-146130 | A | 5/1996 |
| JP | 9-119983 | A | 11/1996 |
| WO | WO 94/14251 | | 6/1994 |
| WO | WO 99/50985 | | 10/1999 |

OTHER PUBLICATIONS

Gendreau et al., Airport Pavement management Systems: An Appraisal of Existing Methodologies, 1998, Transpn Res.-A, vol. 32, No. 3, pp. 197-214.*

Keegan et al., Need for Accurate Traffic Data in Pavement Management: John F. Kennedy International Airport Case Study, Apr. 2004, FAA Worldwide Airport Technology Transfer Conference, pp. 1-13.*

Traffic Alert System Technical Design Summary, Final Report, Apr. 1994 (Baldwin et al.).

GPS Relative Accuracy for Collision Avoidance, Institute of Navigation Technical Meeting, Jan. 1997 (Rudel et al.).

Cassell, R., Smith A., Cohen, B., Yang, E., Sleep, B., A Prototype Aircraft Performance Risk Assessment Model, Final Report, Rannoch Corporation, Feb. 28, 2002.

Cassell, R., Smith A., Cohen, B., Yang, E., Sleep, B., Esche, J., Aircraft Performance Risk Assessment Model (APRAM), Rannoch Corporation, Nov. 30, 2002.

Cox, E., A., Fuzzy Logic Business and Industry, Charles River Media, 1995, Chapter 5.

Smith, A., Cassell, R., Cohen, B., An approach to Aircraft Performance Risk Assessment Modeling, Final Report, Rannoch Corporation, Mar. 1999.

M.L. Wood and R. W. Bush, "Multilateration on Mode S and ATCRBS Signals at Atlanta's Hartsfield Airport" , Lincoln Laboratory, M.I.T., Jan. 8, 1998.

AERMOD: Description of Model Formulation (Version 02222) EPA 454/R-02-002d, Oct. 21, 2002.

FAA Integrated Noise Model, www.faa.gov, current release INM 6.1 (Mar. 4, 2003).
"Flight Explorer News: Flight Explorer and Lochard Team to Provide Enhanced Flight Tracking for Cutomers Worldwide", Apr. 28, 2003, http://www.flightexplorer/com/News/press%20releases/pr042803.asp.
Source Code received by Rannoch Corp. from FAA, circa 1998.
"A Routine that converts an American Mode S address into its corresponding 'N' number string", Ken Banis, Feb. 17, 1992.
"Description of the U.S. Algorithm for Assigning Mode A Addresses", Robert D. Grappel, M.I.T. Lincoln Laboratory, Nov. 1991.
"Program to convert Mode S address to U.S. Tail Number", R.D. Grappel, M.I.T. Lincoln Laboratory, 1991.
"Program to convert U.S. aircraft tail numbers to Mode S code", R.D. Grappel, M.I.T. Lincoln Laboratory, 1991.
"ADSE and Multilateration Mode-S Data Fusion for Location and Identification on Airport Surface", J.G. Herraro J.A. Portas, F.J. Rodriguez, (*IEEE 1999 Radar Conference Proceedings*, pp. 315-320, Apr. 20-22, 1999).
D.C. Rickard, D.J.Sherry, S.J.Taylor, "The development of a prototype aircraft-height monitoring unit utilising an SSR-based difference in time of arrival technique", International Conference Radar 92 (Conf. Publ. No. 365), 1992, p. 250-3.
D.E. Manolakis and C. C. Lefas, "Aircraft geometric height computation using secondary surveillance radar range differences," IEE Proceedings-F, Radar, Sonar, Navigation, vol. 141, No. 2, pp. 139-148, 1994.
Request for Proposal for Acquisition of Airport Noise and Operations Monitoring System (NOMS), Indianapolis Airport Authority, Oct. 21, 2003.
Technical Specifications, for Aircraft Flight Track and Noise Management System for the Regional Airport Authority of Louisville and Jefferson County, Harris Miller, Miller & Hanson Inc. 15 New England Executive Park Burlington, MA 01803 HMMH Report No. 298950, May 16, 2003.
"Overview of the FAA ADS-B Link Decision", John Scardina, Director, Office of System Architecture and Investment Analysis, Federal Aviation Administration, Jun. 7, 2002.
"Ground-Based Transceiver (GBT) For Broadcast Services Using the Universal Access Transceiver (UAT) Data Link", FAA-E-2973, Department of Transportation, Federal Aviation Administration, Jan. 15, 2004.
"Wide Area Multilateration Report on EATMP TRS 131/04 Version 1.1", NCR-CR-2004-472, Roke Manor, Nov. 2004.
J.G. Herrero, J. A. B. Portas, F.J.J. Rodriguez, J.R.C. Corredera, ASDE and Multilateration Mode-S Data Fusion for Location and Identification on Airport Surface, (*IEEE 1999 Radar Conf. Proc.*, pp. 315-320, Apr. 20-22, 1999).
D.C. Rickard, D.J. Sherry, S.J. Taylor, The Development of a prototype aircraft-height monitoring unit utilizing an SSR-based difference in the time of arrival technique, Int'l Conference Radar 92 (Conf. Publ. No. 365). 1992, p. 250-3
D. E. Manolakis and C. C. Lefas, Aircraft geometric height computation using secondary surveillance radar range differences,□ IEE Proceedings-F, Radar, Sonar, Navigation, vol. 141, No. 2, pp. 139-148, 1994.
GPS Risk Assessment Study, Final Report, T.M. Corrigan et al., Johns Hopkins Univ., Applied Physics Laboratory, Jan. 1999.
Aircraft Noise Report, vol. 17, No. 1, Jan. 31, 200.
ASA MASPS—Change Issue, James Maynard, Oct. 21, 2002.
ADS-B, Automatic Dependent Surveillance—Broadcast Will ADS-B Increase Safety and Security for Aviation?, Mar. 1999, revised Jul. 2000, Darryl H. Phillips AirSport Corporation, 1100 West Cherokee Sallisaw OK 74955.
ASA MASPS—Change Issue, Greg Stayton, Aug. 1, 2002.
ASA MASPS—Change Issue, Micheal Petri, Oct. 23, 2002.
ASA MASPS—Change Issue, J. Stuart Searight, Nov. 18, 2002.
ASA MASPS—Change Issue, Michael Petri, Dec. 16, 2002.
ASA MASPS—Change Issue, J. Stuart Searight, Jan. 23, 2003.
ASA MASPS—Change Issue, Tony Warren, Feb. 3, 2003.
ASA MASOS—Change Issue, Steve George, Apr. 23, 2003.
ASA MASPS—Change Issue, James Maynard, Apr. 23, 2003.
ASA MASPS—Change Issue, T.E. Foster, Jun. 11, 2003.
ASA MASPS—Change Issue, Jonathan Hammer et al., Jan. 13, 2004.
ASA MASPS—Change Issue, Tom Mosher, Jan. 13, 2004.
ASA MASPS—Change Issue, Mike Castle, Feb. 13, 2004.
ASA MASPS—Change issue, Tony Warren, Sep. 10, 2004.
ASA MASPS—Change Issue, Mike Castle, Sep. 10, 2004.
ASA MASPS—Change Issue, Bob Smith, Sep. 1, 2004.
ASA MASPS—Change Issue, Heleberg and Kaliardos, Oct. 15, 2004.
ASA MASPS—Change Issue, Taji Shafaat, Sep. 19, 2004.
ASA MASPS—Change Issue, Stuart Searight, Nov. 3, 2004.
A Radar Substitute—David Hughes, Aviation Week & Space Technology, Mar. 7, 2005.
Statement of ACI-NA and AAAE on Airport Improvement Program Reauthorization before the Senate Aviation Subcommittee on Feb. 12, 1998. Devid Plavin.
Draft Proposal for the amendment of the Sub-Cap on Off-Peak Take-off and Landing Charges at Dublin Airport, Commission for Aviation Regulation, Nov. 23, 2003.
Aviation Infrastructure: Challenges Associated with Building and Maintaining Runways, General Accounting Office, GAO-01-90-T, Oct. 5, 2000.
Airfield Pavement: Keeping Nations Runways in Good Condition Could Require Substantially higher Spending, GAO/RCED-98-226, Jul. 1998.
Albany International Airport Pavement Management System, Albany, New York, Albany International Airpport GIS-Based Pavement and Facilities Management, Fall, 2002.
Albany International Airport, New York, Uses GIS for Pavement Management, Lana Weber, Ph.D., GIS Manager, and Pat Rooney, GIS/GPS Technician, C.T. Male Associates, Summer, 2002, http://www.esri.com/news/arcnews/summer02articles/albany-airport.html.
Micropaver, Dr. M.Y. Shahin, CECER-CFF Champaign, IL May 2, 2005.
Raytheon Systems Limited Launches a Unique Solution for ADS-B,. Jan. 19, 2005, Raytheon Corp. http://www.raytheon.co.uk/highlights/ATMS.html.
Raytheon Systems Limited's ADS-B Solution Prised by International Sir tzraffic Authorities, Feb. 2, 2005, http://www.raytheon.co.uk/news_room/news/press_02022005.pdf.
http://www.eurocontrol.be/care/asas.tn-workshop1/asas-tn-vanderkraan2.ppt, Apr. 28-30, 2003.
http://www.eurocontrol.be/care/asas/tn-workshop1/asas-tn-howlett.ppt, Apr. 28-30, 2003.
Boeing Subsidiary and Magadata Announce Joint Marketing Agreement, Press Release, Aug. 7, 2003.
VDL4 TM Alignment with DO-242A (RTCA ADS-B MASPS) WG51/SG2, NASA, Sep. 2003.
Method to Provide System-Wide ADS-B Back-up, Validation, and Security, A. Smith et al. 25th AIAA/IEEE Digital Avionics Systems Conference, Oct. 15, 2006.
*Positive Identification of Aircraft on Surface Movement Area—Results of FAA Trials*, 10th Annual International AeroSense Symposium, Orlando, Florida, Apr. 1996.
*Surveillance Monitoring of Parallel Precision Approaches in a Free Flight Environmen*, AIAA 16th Annual Digital Avionics Systems Conference, Oct. 1997.
*Analysis of ADS-B, ASDE-3 and Multilateration Surveillance Performance*—NASA Atlanta Demonstration Presented at the AIAA 17th Annual Digital Avionics Systems Conference in Oct. 1998.
*Atlanta Hartsfield International Airport—Results of FAA Trials to Accurately Locate/Identify Aircraft on the Airport Movement Area,* IEEE Plans, Atlanta, GA, Apr. 1996.
*Evaluation of Airport Surface Surveillance Technologies*, IEEE Radar 96 conference, Beijing, China, Oct. 1996.
*Improved Location/Identification of Aircraft/Ground Vehicles on Airport Movement Areas—Results of FAA Trials*, Institute of Navigation in Santa Monica, CA, Jan. 1996.
*Sensis News*, http://www.sensis.com/docs/128/ © 1999-2006.

*Roke Radar, Design and development of maniature radars and fuze sensors through to major radar programme builds*, http://www.roke.co.uk.skills/radar/, © 2006.
*Acoustic Systems for Aircraft Detection and Tracking, based on Passive Microphone Arrays.* Caronna, Rosello, Testa, 148th Meeting of the Acoustical Society of America, http://pcfite.ing.uniroma1.it/upload/research/4psp711079482021710.pdf Nov. 2004.
*Cel-Loc How We Do It, Technology Overview*, http://www.cell-loc.com/how_tech.html, Oct. 2, 2006 (original date unknown).
*Super-Radar, Done Dirt Cheap*, http://www.businessweek.com/magazine/content/03_42/b3854113.htm BusinessWeek Online, Oct. 20, 2003.
*Methods to Provide System-Wide ADS-B Back-Up, Validation and Security*, A. Smith, R. Cassell, T. Breen, R. Hulstrom, C. Evers, 25th AIAA/IEEE Digital Avionics Systems Conference, Oct. 15, 2006.
Damarel Systems International, Ltd, Travel Automation Specialists, © 2004, www.dameral.com.
Airfield Pavement Computer Software, Mar. 23, 2005, Transport Canada https://www.tc.gc.ca/CivilAviation/International/Technical/Pavement/software.htm.
ARA Transportation, © 2004, http://www.araworldwide.com/expertise/industry/transportation.htm.
Protest Letter dated May 16, 2002 from Otto M. Wildensteiner, U.S. Department of Transportation, Washington, DC.
"Comparison of Claims in U.S. Appl. No. 09/971,672 with Prior Art", May 16, 2002, Otto M. Wildensteiner, Department of Transporation, Washington DC.
"Minimum Aviation System Performance Standards for Automatic Dependent Surveillance Broadcast (ADS-B)", RCTA, Inc. Washington, DC, © 1998.
"Runway Incursion Reduction Program Dallas-Ft, Worth Formal Evaluation Report, Final Report", Trios Associates, Inc. Dec. 21, 2000.
"TIS-B DFW Application for Airport Surface Situational Awareness", Trios Associates, Inc., Sep. 6, 2000.
"A Prototype Transceiver for Evaluating An Integrated Broadcast Data Link Architecture", Chris Moody & Warrent Wilson, RCTA SC-186, Aug. 17, 1995, RTCA Paper No. 449-95/SC186-033.
"The Universal Access Transceiver (UAT)", Warren Wilson & Chris Moody, May 10, 1995.
"Terminal Area Productivity (TAP) Study Low Visibility Landing and Surface Operations (LVLASO) Demonstration Report" Surface Surveillance Products Team (AND-410) Sep. 4, 1998.
"Phase I—Operational Evaluation Final Report Cargo Airline Association ADS-B Program, FAA SafeFlight 21 Program" Apr. 10, 2000.
"Capstone Program Plan Version 1.0", Federal Aviation Administration, Mar. 10, 1999.
"TIS-B Concept and Approach", MITRE , Chris Moody, Feb. 29, 2000.
"RTCA Special Committe 186, Working Group 5 ADS-B UAT MOPS Meeting 190 2, Proposed Contents and Transmission Rates for ADS-B Messages" Chris Moody, MITRE Corp., Feb. 20, 2001.
"Airborne Information Initiatives: Capitalizing on a Multi-Purpose Broadcast Communications Architecture", R.C. Strain, J.C. Moody, E.C. Hahn, B.E. Dunbar, S. Kavoussi, J.P. Mittelman, Digital Avionics Systems Conference, Oct. 1995.
"Minutes of SC-186 WG-2 (TIS-B) Meeting", Jun. 13-14, 2000.
*Twilight Zone, Can Wide-Area Multilateration Systems Become a Nightmare for MSSR Products*? Aircraft Traffic Technology International 2005, Vladimir Manda, Viktor Sotona.
Safety, Performance, and Interoperability Requirments Document for ADS-B NRA Application, European Organisation for Civil Avaiation Equipment, Dec. 2005.
Passive Surveillance Using Multilateration, Roke Manor Research website (2003).
Letter from Marc Morgan, Siemens, Feb 10, 2006
*Required Navigation Performance (RNP) and Area Navigation (RNAV)*, Boeing, Aug. 2000.
*System-Wide ADS-B Back-Up and Validation*, A. Smith R. Cassell, T. Breen, R. Hulstrom C. Evers, 2006 Integrated Communications, Navigation, and Surveillance Conference.
Required Navigation Performance (RNP) Another step towards global implementation of CNS/ATM, Anita Trotter-Cox, Assessment Compliance Group, Inc. Published in Professional Pilot Magazine, Jun. 1999.
Airport Pavement Management Systems: An Appraisal of Erxisting Methodologies, Michel Gendreau and Patrrick Soriano;Pergamon Transn Res. A, vol. 32, No. 3, pp. 187-214, 1998.
*Components of a Pavement Maintenance Management Systems*, Mohamed Y. Shahin, U.S. Army Construction Engineering Research Laboratory, Transportation Research Record 791, pp. 31-39, 1980.
*Application of Markov Process to Pavement Management Systems at the Network Level*, Abbas Ahmad Butt, University of Iillinois at Urbana-Champaign (1991).
Need for Accurate Traffic Data in Pavement Management, John F. Kennedy Internation Airport Case Studt, Keegan, Handojo, Rada, MACTEX Engineering and Consulting, Inc, 2004 FAA Worldwide Airport Technology Transfer Conference, Apr. 2004.

* cited by examiner

*Primary Examiner*—Michael P. Nghiem
*Assistant Examiner*—Toan M Le
(74) *Attorney, Agent, or Firm*—Robert Platt Bell

(57) ABSTRACT

The AirScene™ Pavement Management System of the present invention automatically tracks data required to determine various factors in an assessment of current and future pavement maintenance needs and utilizes this data to quantify the pavement damage caused by each individual aircraft movement and thus compute pavement condition based on an initial survey and the calculations of accrued damage over time. This information can be displayed through AirScene™ in the form of tables, graphs, or graphically represented on an airport diagram showing present conditions, rates of accruing damage, and future wear rates and areas. The system draws on the data from the AirScene™ Data Warehouse (ADW), a single repository for all the information acquired from a number of different sources. These data include: Aircraft or vehicle type (wheel layout, weight, vehicle specific parameters, and the like), Aircraft or vehicle location (ground track, position, gate used, and the like), Aircraft or vehicle dynamics (velocity, acceleration, take off, touchdown, and the like), Aircraft or vehicle actual weight (cargo load, fuel load, and the like), as well as Future operational data (flight schedules, increasing flight loads and demand, and the like).

54 Claims, 3 Drawing Sheets

AIRPORT PAVEMENT MANAGEMENT SYSTEM

CROSS-REFERENCE TO RELATED APPLICATIONS

The present application is a Continuation-In-Part application of U.S. patent application Ser. No. 10/743,042, filed on Dec. 23, 2003, now U.S. Pat. No. 7,132,982 and incorporated herein by reference; U.S. patent application Ser. No. 10/743,042 in turn is a Continuation-In-Part Application of U.S. patent application Ser. No. 10/638,524, filed on Aug. 12, 2003, entitled "METHOD AND APPARATUS FOR IMPROVING THE UTILITY OF AUTOMATIC DEPENDENT SURVEILLANCE", now U.S. Pat. No. 6,806,829, which is incorporated herein by reference in its entirety, which in turn is a Continuation of U.S. patent application Ser. No. 09/516,215, filed on Feb. 29, 2000, now U.S. Pat. No. 6,633,259, which in turn claims priority from Provisional Application Ser. No. 60/123,170, filed on Mar. 5, 1999, both of which are incorporated herein by reference in its entirety; U.S. patent application Ser. No. 10/743,042 is also a Continuation-In-Part of U.S. patent application Ser. No. 10/319,725, filed on Dec. 16, 2002, entitled "VOICE RECOGNITION LANDING FEE BILLING SYSTEM", now U.S. Pat. No. 6,812,890, incorporated herein by reference in its entirety; U.S. patent application Ser. No. 10/743,042 is also a Continuation-In-Part U.S. patent application Ser. No. 10/457,439, filed on Jun. 10, 2003, entitled "CORRELATION OF FLIGHT TRACK DATA WITH OTHER DATA SOURCES", now U.S. Pat. No. 6,885,340, incorporated herein by reference in its entirety; U.S. patent application Ser. No. 10/743,042 also claims priority from Provisional U.S. Patent Application No. 60/343,237, filed on Dec. 31, 2001, incorporated herein by reference in its entirety; The present Application is also a Continuation-In-Part Application of U.S. patent application Ser. No. 11/031,457, filed on Jan. 7, 2005, still pending and incorporated herein by reference, which in turn is a Continuation-In-Part Application of U.S. patent application Ser. No. 10/638,524, filed on Aug. 12, 2003, entitled "METHOD AND APPARATUS FOR IMPROVING THE UTILITY OF AUTOMATIC DEPENDENT SURVEILLANCE", now U.S. Pat. No. 6,806,829, which is incorporated herein by reference in its entirety, which in turn is a Continuation of U.S. patent application Ser. No. 09/516,215, filed on Feb. 29, 2000, now U.S. Pat. No. 6,633,259, which in turn claims priority from Provisional U.S. Application Ser. No. 60/123,170, filed on Mar. 5, 1999, all of which are incorporated herein by reference in its entirety; U.S. patent application Ser. No. 11/031,457 is also a Continuation-In-Part of U.S. patent application Ser. No. 10/319,725, filed on Dec. 16, 2002, entitled "VOICE RECOGNITION LANDING FEE BILLING SYSTEM", now U.S. Pat. No. 6,812,890, incorporated herein by reference in its entirety; U.S. patent application Ser. No. 11/031,457 is also a Continuation-In- Part of U.S. patent application Ser. No. 10/457,439, filed on Jun. 10, 2003, entitled "CORRELATION OF FLIGHT TRACK DATA WITH OTHER DATA SOURCE", now U.S. Pat. No. 6,885,340, incorporated herein by reference in its entirety; U.S. patent application Ser. No. 11/031,457 also claims priority from Provisional U.S. Patent Application Ser. No. 60/440,618, filed on Jan. 17, 2003, incorporated herein by reference in its entirety; The present application is also a Continuation-In-Part Application of U.S. patent application Ser. No. 10/756,799, filed on Jan. 14, 2004, now U.S. Pat. No. 7,126,534, and incorporated herein by reference; U.S. patent application Ser. No. 10/756,799 is also a Continuation-In-Part Application of U.S. patent application Ser. No. 10/638,524, filed on Aug. 12, 2003, entitled "METHOD AND APPARATUS FOR IMPROVING THE UTILITY OF AUTOMATIC DEPENDENT SURVELLANCE", now U.S. Pat. No. 6,806,829, which is incorporated herein by reference in its entirety, which in turn is a Continuation of U.S. patent application Ser. No. 09/516,215, filed on Feb. 29, 2000, now U.S. Pat. No. 6,633,259, which in turn claims priority from Provisional U.S. Application Ser. No. 60/123,170, filed on Mar. 5, 1999, both of which are incorporated herein by reference in their entirety; U.S. patent application Ser. No. 10/756,799 is also a Continuation-In-Part of U.S. patent application Ser. No. 10/319,725, filed on Dec. 16, 2002, entitled "VOICE RECOGNITION LANDING FEE BILLING SYSTEM", now U.S. Pat. No. 6,812,890, incorporated herein by reference in its entirety, which in turn claims priority from Provisional U.S. Patent Application Ser. No. 60/343,237, filed on Dec. 31, 2001, also incorporated by reference in its entirety; U.S. patent application Ser. No. 10/756,799 is also a Continuation-In-Part of U.S. patent application Ser. No. 10/457,439, filed on Jun. 10, 2003, entitled "CORRELATION OF FLIGHT TRACK DATA WITH OTHER DATA SOURCE", now U.S. Pat. No. 6,885,340, incorporated herein by reference in its entirety; U.S. patent application Ser. No. 10/756,799 is also a Continuation-In-Part of U.S. patent application Ser. No. 10/751,115, filed on Jan. 5, 2004, entitled "METHOD AND APPARATUS TO CORRELATE AIRCRAFT FLIGHT TRACKS AND EVENTS WITH RELEVANT AIRPORT OPERATIONS INFORMATION", now U.S. Pat. No. 6,992,626, which in turn claims priority from Provisional U.S. Patent Application Ser. No. 60/440,618, filed on Jan. 17, 2003, incorporated herein by reference in its entirety; U.S. patent application Ser. No. 10/756,799 also claims priority from Provisional U.S. Patent Application Ser. No. 60/440,618, filed on Jan. 17, 2003, incorporated herein by reference in its entirety; U.S. patent application Ser. No. 10/756,799 is also a Continuation-In-Part of U.S. patent application Ser. No. 10/743,042, filed on Dec. 23, 2003, entitled "METHOD AND APPARATUS FOR ACCURATE AIRCRAFT AND VEHICLE TRACKING" (Alexander E. Smith et al.), now U.S. Pat. No. 7,132,982, incorporated herein by reference; U.S. patent application Ser. No. 10/756,799 also claims priority from Provisional U.S. Patent Application Ser. No. 60/534,706, filed on Jan. 8, 2004, incorporated herein by reference in its entirety; The present application is a Continuation-In-Part application of U.S. patent application Ser. No. 10/830,444, filed on Apr. 23, 2004, now U.S. Pat. No. 7,123,192 and incorporated herein by reference; U.S. patent application Ser. No. 10/830,444 is a DIVISIONAL Application of U.S. patent application Ser. No. 10/457,439, filed on Jun. 10, 2003, now U.S. Pat. No. 6,885,340, and incorporated herein by reference; U.S. patent application Ser. No. 10/457,439 in turn was a Continuation-In-Part Application of U.S. patent application Ser. No. 09/516,215, filed on Mar. 5, 1999, entitled "METHOD AND APPARATUS FOR IMPROVING THE UTILITY OF AUTOMATIC DEPENDENT SURVEILLANCE", now U.S. Pat. No. 6,633,259, which is incorporated herein by reference in its entirety; U.S. patent application Ser. No. 10/457,439 was also a Continuation-In-Part of U.S. patent application Ser. No. 10/319,725, filed on Dec. 16, 2002, entitled "VOICE RECOGNITION LANDING FEE BILLING SYSTEM", now U.S. Pat. No. 6,812,890, incorporated herein by reference in its entirety; U.S. patent application Ser. No. 10/457,439 also claims priority from Provisional U.S. Patent Application No. 60/440,618, filed on Jan. 17, 2003, incorporated herein by reference in its entirety; The present application is also a Continuation-In-Part of U.S. patent application Ser. No. 11/111,957, filed on Apr. 22, 2005, now abandoned and incorporated herein by reference.

The subject matter of the present application is related to the following issued U.S. Patents, assigned to the same assignee as the present invention, all of which are incorporated herein by reference in their entirety:

U.S. Pat. No. 5,999,116, issued Dec. 7, 1999, entitled "Method and Apparatus for Improving the Surveillance Coverage and Target Identification in a Radar Based Surveillance System";

U.S. Pat. No. 6,094,169, issued Jul. 25, 2000, entitled "Passive Multilateration Auto-Calibration and Position Error Correction";

U.S. Pat. No. 6,211,811, issued Apr. 2, 2001, entitled "Method and Apparatus for Improving the Surveillance Coverage and Target Identification in a Radar Based Surveillance System";

U.S. Pat. No. 6,384,783, issued on May 7, 2002, entitled "Method and Apparatus for Correlating Flight Identification Data With Secondary Surveillance Radar Data";

U.S. Pat. No. 6,448,929, issued Sep. 10, 2002, entitled "Method and Apparatus for Correlating Flight Identification Data With Secondary Surveillance Radar Data";

U.S. Pat. No. 6,567,043, issued May 20, 2003, entitled "METHOD AND APPARATUS FOR IMPROVING THE UTILITY OF AUTOMATIC DEPENDENT SURVEILLANCE";

U.S. Pat. No. 6,633,259 issued Oct. 14, 2003 "METHOD AND APPARATUS FOR IMPROVING THE UTILITY OF AUTOMATIC DEPENDENT SURVEILLANCE";

U.S. Pat. No. 6,806,829, issued Oct. 19, 2004, entitled "METHOD AND APPARATUS FOR IMPROVING THE UTILITY OF AUTOMATIC DEPENDENT SURVEILLANCE";

U.S. Pat. No. 6,812,890, issued Nov. 2, 2004, entitled "VOICE RECOGNITION LANDING FEE BILLING SYSTEM"; and U.S. Pat. No. 6,885,340, issued Apr. 26, 2005, entitled "CORRELATION OF FLIGHT TRACK DATA WITH OTHER DATA SOURCES".

FIELD OF THE INVENTION

The present invention relates to a system of software and hardware for monitoring and predicting pavement conditions. In particular, the present invention is directed towards a system for use at airports to allow the airport to use aircraft and vehicle ground track, flight track, and meteorological conditions data for the purpose of monitoring and predicting maintenance requirements of pavement at the airport.

BACKGROUND OF THE INVENTION

Maintaining pavement at an airport is critical to keeping the airport at full capacity and maintaining a cost-effective operation. The Government Accounting Office (GAO) stated in a report in 1998 (http://www.gao.gov/archive/1998/rc98226.pdf, incorporated herein by reference) that pavement is in poor condition requires much more drastic repair than pavement maintained in good condition. This increase in repair costs varies between two to three times more than it would have cost to repair pavement that was in good condition. Monitoring conditions of pavement is critical to decision makers at an airport who must decide when to allocate recourses to effectively maintain airport operational status.

The GAO report also recommended that the FAA consider options for developing a pavement management system to track the condition of the runways so that repairs could be conducted in a timely and cost-effective manner.

Although not a direct noise monitoring responsibility, pavement management has a strong environmental component and many airport offices dealing with noise management also have to deal with pavement management issues. The software and system of the present invention was developed after discussions with existing AirScene clients, as well as potential new clients where pavement age and condition has become both an environmental and capacity issue.

Runway maintenance issues may involve airport staff from accounting, operations, noise and air quality (environmental), air traffic control, and many others. Gerald L. Dillingham, the GAO's Director of Physical Infrastructure, related the problems associated with building and maintaining runways and the environment in his testimony before Congress in October 2000 (http://www.gao.gov/new.items/d0190t.pdf, incorporated herein by reference).

Runways requiring maintenance are often closed so that those maintenance operations can be completed. These closures normally occur at night to minimize the impact on airport operations. Aircraft may have to be diverted to non-preferred runways during these maintenance periods and thus causing aircraft to over-fly areas rarely seeing activity during that time period. These flyovers may generate a number of noise and other complaints and more severe responses if the closures are for longer durations.

The accepted practice for determining the conditions of the pavement at airports is a manually intensive and time-consuming process. Trained airport staff or consultants must manually inspect and grade the pavement on a scale from 0 to 100. This rating is known as the pavement condition index (PCI). Semi-automated processes have been developed using a variety of technologies to scan pavement and automatically rate the pavement on the PCI scale. These systems can process more pavement area in a shorter time, however runways and pavement undergoing analysis must be closed and clear of traffic during the inspection, as equipment to inspect the pavement must be driven over the runway.

Software and systems do exist to help an airport manage its pavement based on the results of these subjective inspections. The most popular program for logging the PCI was developed by the Army Corps of Engineers under contract from the FAA. The software is known as "Micro PAVER" and is available the Corps (http://www.cecer.army.mil/paver/, incorporated herein by reference) for a nominal fee. Other software is available on the commercial market and includes AIRPAV (http://www.airpav.com/airpav.htm, incorporated herein by reference) from Eckose/Green. However the Micro PAVER software is the most popular system presently in use at most airports.

Consultants such as C.T. Male Associates, working with GIS software company ESRI, have developed their own semi-automated systems (See, e.g., http://cobalt.ctmale.com/AirportGIS.htm, incorporated herein by reference, and http://www.esri.com/news/arcnews/summer02articles/albany-airport.html, also incorporated herein by reference). This system was developed for an airport in Albany NY. The system uses wireless hand-held computers with GPS to categorize and log the PCI. Systems of this type are also under development at other airports including a system currently under development by Aeroware (http://www.aeroware.com, incorporated herein by reference) at a general aviation airport in the western United States.

This type of quasi-automation saves some time and labor but still requires physical inspection and closure of the runway, taxiways, or ramp areas. These systems are useful for predicting maintenance needs only if supplied regularly with PCI survey data and data from quantified defects analysis. Acquiring the type of data that these systems need is time consuming, costly, and is labor intensive.

Other products on the market such as the product called A.I.R.P.O.R.T.S. by Dynatest (http://www.dynatest.com/software/airppms.htm, incorporated herein by reference) also rely on manual measurements and tests done on the physical pavement to assess the condition. Dynaport's PMS product can use visual PCI data, structural data from the Heavy Falling Weight Deflectometer, skid resistance data, and functional data from the Road Surface Profiler. All of this data is acquired in the field.

In order to be useful as a pavement condition assessment and prediction tool, these types of systems rely on frequent measurements of the physical characteristics of the pavement in order to determine when to repair the pavement. This type of physical inspection-based system has become popular in the absence of autonomous techniques.

Since airlines were deregulated, the number of flights at many airports has increased dramatically. Dismantling the hub-and-spoke routing system may result in the more direct point-to-point flights, which may result in more takeoffs and landings at smaller regional airports, which have less manpower an infrastructure available to monitor pavement conditions on a regular basis.

In addition, the advent of larger airliners such as the Boeing 777 and the Airbus A380 may result in greater wear in runways and taxiways due to the increased weight of these newer aircraft. Merely counting landings and takeoffs of aircraft may be an insufficient indicia of pavement wear, as these heavier aircraft may cause many times the wear of more traditional, smaller aircraft.

Moreover, as airports expand, many extended taxiways may be in use. Depending upon prevailing wind conditions, airport and terminal layout, the amount of use of each taxiway and runway may vary considerably. Thus, for example, if prevailing winds at an airport are consistently from one direction, one runway (or set of runways) may experience substantially more wear than other, lesser-used runways. Repaving all runways and taxiways after a predetermined amount of time or after a predetermined number of takeoff/landing cycles may represent an inefficient use of airport maintenance resources, as some runways and taxiways may experience considerable wear, while others are still in usable condition. Moreover, using such arbitrary criteria to determine pavement condition may fail to detect pavement degradation in some frequently used taxiways and runways.

Thus, it remains a requirement in the art to provide a means for accurately determining pavement conditions at various parts of an airport to provide an computerized model of pavement conditions to assist airport managers in making effective determinations of which areas of the airport pavement infrastructure to repair, and when to make such repairs.

SUMMARY OF THE INVENTION

The Rannoch Corporation AirScene™ Pavement Management System includes a software module, which may be integrated within the Rannoch AirScene™ airport management suite of programs. The AirScene™ suite of programs is described, for example, in its various embodiments described by the Patent Applications and issued Patents cited above and incorporated by reference. The AirScene system is available from Rannoch Corporation of Alexandria, Va., assignee of the present application.

Pavement failure can be caused by a number of different contributing factors. The most important include Internal structural defects (poor materials, improper packing, lack of drainage), Environmental influences (heat/cool and freeze/thaw cycles, rainfall, temp etc.), and Number of aircraft/vehicles and pavement loading (high volumes and axel loads). The AirScene™ Pavement Management System of the present invention automatically tracks data required to determine all of these factors in an assessment of current and future pavement maintenance needs.

The AirScene™ Pavement Management System utilizes this data to quantify the pavement damage caused each individual aircraft movement. This cumulative data allows AirScene™ to compute pavement condition based on an initial survey and the calculations of accrued damage over time. This information can be displayed through AirScene™ in the form of tables, graphs, or graphically represented on an airport diagram. The display can show current conditions, rates of accruing damage, and future wear rates and areas.

The system draws on the data from the AirScene™ Data Warehouse (ADW). The ADW represents a single repository for all the information acquired from a number of different sources. These data include: Aircraft or vehicle type (wheel layout, weight, vehicle specific parameters, and the like), Aircraft or vehicle location (ground track, position, gate used, and the like), Aircraft or vehicle dynamics (velocity, acceleration, take off, touchdown, and the like), Aircraft or vehicle actual weight (cargo load, fuel load, and the like), as well as Future operational data (flight schedules, increasing flight loads and demand, and the like).

The data acquired and stored by AirScene is the key to predicting the future maintenance requirements of the pavement. The system can use aircraft and vehicle tracking data from a variety of sources including AirScene MLat, ADS-B, ASDE-X, ASDE-3, AMASS, ASDE, and others to determine the type of aircraft or vehicle, the type of operation (taxi, park, departure, or arrival), where the aircraft or vehicle operated, and also which runways, taxiways, and gates were used.

The system can also utilize data from the ACARS including the weight of the aircraft, fuel, and cargo, the time at the gate, time and position of wheels off the ground, wheels on the ground, and the like. Knowing where the aircraft was, how much it weighed, how long it was on a particular section of pavement is critical to determine the wear and tear on the pavement.

Weather information and operational data from the D-ATIS, ASOS, METAR, and TAF is also very important in the calculation of pavement condition. Pavement has a limited life-cycle and weather factors help to accelerate the wear and tear. Pavement life can be shortened by the amount of sun, rain, ice, and freeze/thaw cycles to which the pavement is exposed.

This data can accurately determine how much wear occurs to an airport surface, based upon actual aircraft and other vehicle tracks, as well as ancillary data such as weather and temperature. Calculations are known in the art for determining wear on pavement surfaces based upon actual usage. From such known civil engineering criteria, combined with actual vehicle tracks and vehicle data, the system of the present invention can accurately predict which portions of an airport surface will need resurfacing or repair at what times. Based upon patterns of usage, the system can predict when runways and other paved surfaces will need to be repaired, such that repairs can be bid out, scheduled, and performed before the actual pavement starts to fail, thus minimizing adverse impact on airport operations as well as reducing pavement repair and maintenance costs.

The AirScene™ Pavement Management System combines all this data into a single calculation of likely pavement condition. Historic data can also be accessed to make predictions about the future maintenance needs of the pavement. Also, scheduled airline operations data from sources such as OAG can be utilized to anticipate future airport operations for the purpose of calculating the future maintenance requirements of the pavement.

The system can also be used as a pavement overload warning system. The basis for the warning system would be an airport pavement map where the different load capacities of each section of pavement were known. If an aircraft, whose actual weight was too high (e.g., jumbo jet or the like), rolled onto pavement (or was heading toward pavement) that was not designed for that weight, a warning would be issued to the airport operator. Physical inspection could be required to insure there was no damage and that there were no foreign objects created that may damage other aircraft.

A landing fee billing system may be implemented whose fees are based on the damage the aircraft is likely to be causing to the pavement. Aircraft that are known to place more stress on the pavement could be assessed higher landing fees to compensate the airport operator for the additional wear and tear. A similar system was proposed for Dublin Ireland (http://www.aviationreg.ie/downloads/addendumcp403v3.pdf, incorporated herein by reference) but since the actual aircraft weights were not known, the system could not utilize the actual physical properties of each individual aircraft. The system was loosely based on a modification of ICAO's aircraft classification numbers (ACN), which are assigned by aircraft type based on the relative value of the damage that aircraft will cause to the pavement.

The system of the present invention may also be used for tracking ground vehicles used to perform pavement inspection. These inspection vehicles can be equipped with a variety of inspection technologies including cameras, ultrasonic detectors, laser, and others. They are driven over the pavement and the instrumentation feeds pavement condition data to an on-board computer. This data is then correlated with the vehicle position to build a map of pavement condition, which must be uploaded to a traffic management system. The AirScene Pavement Management System can audit this process since the inspection vehicles location is known to the system. The time, date, and position of the inspection vehicle are automatically tracked by the system and stored in the database. Other systems for auditing inspections rely on manual switches (See, e.g., published U.S. Patent application 2005/0021283, incorporated herein by reference). However, these systems do not automatically correlate the inspection data with the position of the vehicle.

The AirScene™ system can also be used to audit the maintenance process of runway rubber removal. Excess rubber from accelerating aircraft tires (upon landing) builds up on the ends of the runways as long black rubber streaks. This build up can adversely affect the coefficient of friction offered by the pavement surface as tested by a grip tester. Rubber may be removed with a variety of environmentally safe methods using machinery mounted on vehicles or the like. The AirScene system can track and record the time, date, and position of these vehicles to verify the affected pavement areas were cleaned.

DETAILED DESCRIPTION OF THE INVENTION

Figure 1:
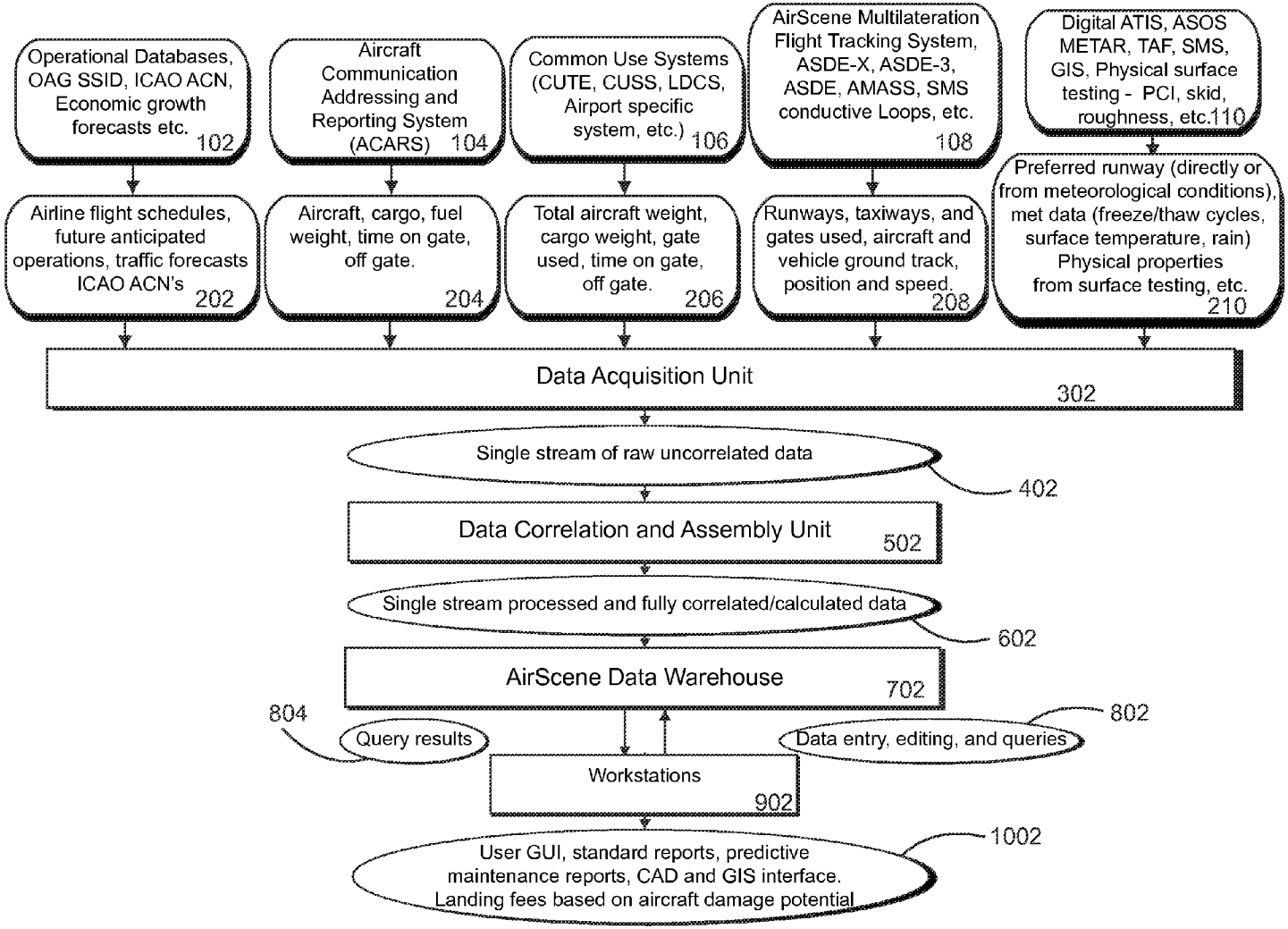
FIG. 1 is a diagram illustrating the data flow through the AirScene system.

FIG. 1 is a block diagram illustrating the major components of the AirScene™ Pavement Management System and the types of data that are utilized. The AirScene™ Pavement Management System utilizes this data to quantify the pavement damage caused each individual aircraft movement. This cumulative data allows AirScene™ to compute pavement condition based on an initial survey and the calculations of accrued damage. This information can be displayed through AirScene™ in the form of tables, graphs, or graphically represented on an airport diagram. The display can show current conditions, rates of accruing damage, and future wear rates and areas.

Referring to FIG. 1, the system draws on data from the AirScene™ Data Warehouse (ADW). The ADW represents a single repository for all the information acquired from a number of different data sources. These data sources may include operational databases 102, from data 202 may include airline flight schedules, future anticipated operations, traffic forecasts, aircraft classification numbers (ACN), and the like. Other databases 104 may includes Aircraft Communication Addressing and Reporting Systems (ACARS) data. This data generated from aircraft by radio signals may include relevant data 204 such as fuel, souls on board, takeoff weight, time at gate, time off gate, and the like.

Figure 2:
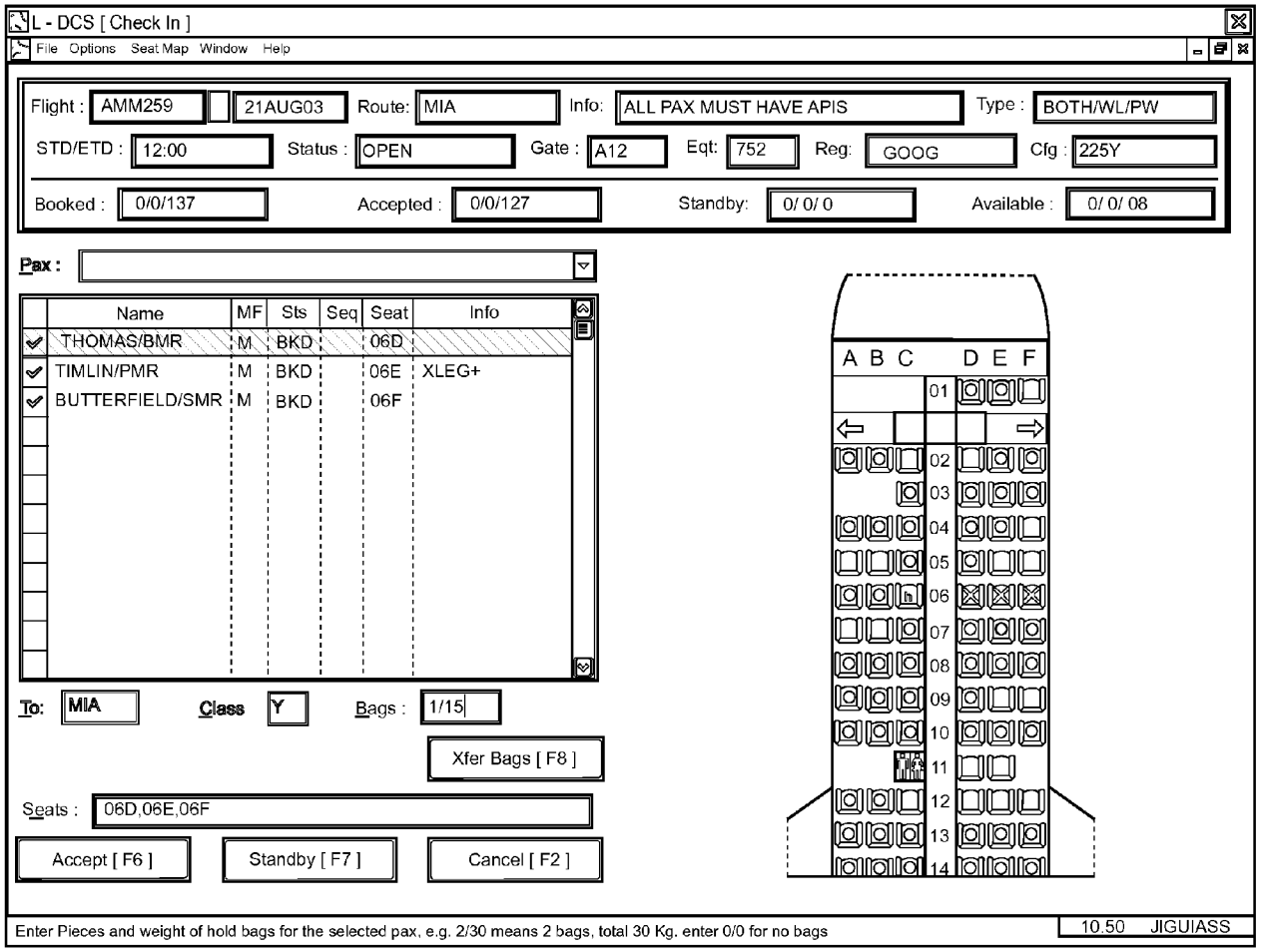
FIG. 2 (Prior Art)
FIG. 2 illustrates an example of data available from Prior Art systems, including aircraft type, passenger load, cargo load, and gate used.
Figure 3:
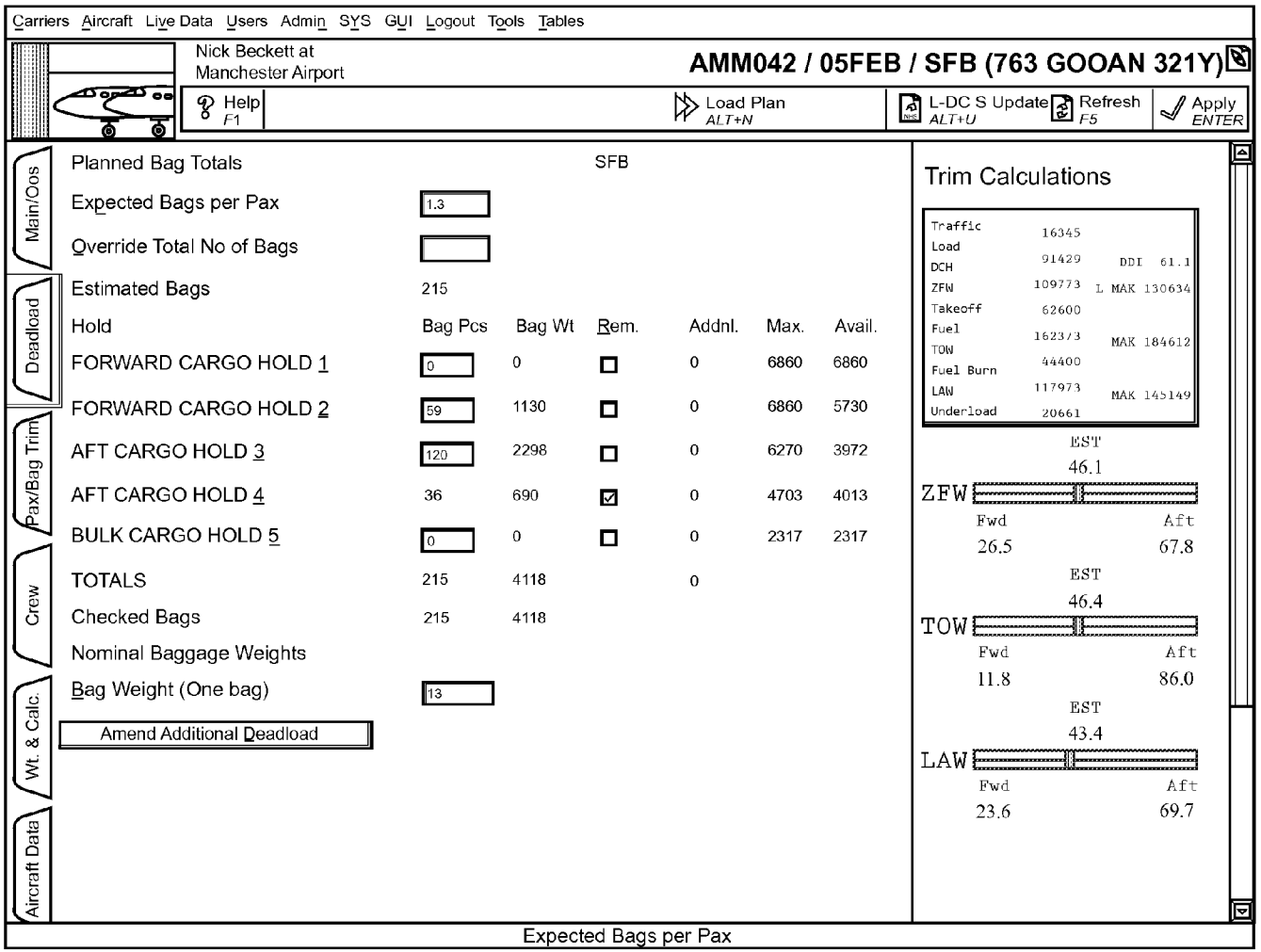
FIG. 3 (Prior Art)
FIG. 3 illustrates another example of data available from Prior Art systems, including aircraft type, passenger load, cargo load, and gate used.

Other databases 106 may include so-called Common Use Systems, which may provide data 206 similar to data 204, including aircraft weight, cargo weight, gate used, and time on and off gate. FIGS. 2 and 3 are examples of data from common use systems sold by Damarel Systems International Ltd (see, http://www.damarel.com, incorporated herein by reference). Illustrating typical information that is available through this type of system including aircraft type, passenger load, cargo load, and gate used.

Aircraft Multilateration Flight Tracking Systems 108 may comprise, for example, Rannoch Corporation's AirScene™ system, which is capable of identifying and tracking aircraft both in the air and on the ground using multilateration of radio signals. Other aircraft tracking systems may also be used, including aircraft sensors mounted in taxiways and runways (e.g. conductive loops or the like) or other types of systems. Data 208 from such systems can produce actual aircraft positions or tracks (paths followed) so as to show exactly where pavement has been used by various aircraft. Position and speed of aircraft can also be determined from such data.

Other data sources 110 may include digital ATIS, ASOS, METAR, physical surface testing, skid testing, surface roughness measuring, or the like. These sources may produce data 210 indicating which runways are preferred, meteorological data (freeze/thaw cycles). Surface temperature, as well as physical properties of pavement.

Note that all of the data sources 102, 104, 106, 108, and 110 do not need to be used in order to produce a satisfactory pavement wear prediction system. Some or all of these sources may be used, and/or additional sources of relevant data may also be applied. Each source of data generates data which may be relevant to pavement wear, condition, or prediction of wear. For example, aircraft weight, speed, and track can predict corresponding wear on pavement in the track path. Weather data can predict environmental wear (e.g., freeze/thaw) on a runway surface, as well as wear effects produced by snow plowing, de-icing, salt, and the like.

Thus, from the data sources described in FIG. 1, numerous useful data can be derived which may be useful to predicting pavement wear. These data include: Aircraft or vehicle type (wheel layout, weight, vehicle specific parameters, and the like), Aircraft or vehicle location (ground track, position, gate used, and the like), Aircraft or vehicle dynamics (velocity, acceleration, take off, touchdown, and the like), Aircraft or vehicle actual weight (cargo load, fuel load, and the like), and Future operational data (flight schedules, increasing flight loads and demand, and the like).

The system can use aircraft and vehicle tracking data from a variety of sources 108 including AirScene MLat, ADS-B, ASDE-X, ASDE-3, AMASS, ASDE, and others to determine data 208 such as type of aircraft or vehicle, the type of operation (taxi, park, departure, or arrival), where the aircraft or vehicle operated, and also which runways, taxiways, and gates were used.

The system can also utilize data 204 from the ACARS 104 including the weight of the aircraft, fuel, and cargo, the time at the gate, time and position of wheels off the ground, wheels on the ground, and the like. Knowing where the aircraft was, how much it weighed, how long it was on a particular section of pavement is critical to determine the wear and tear on the pavement.

Weather information and operational data 210 from the D-ATIS, ASOS, METAR, and TAF 110 is also very important in the calculation of pavement condition. Pavement has a limited life-cycle and weather factors help to accelerate the wear and tear. Pavement life can be shortened by the amount of sun, rain, ice, and freeze/thaw cycles to which the pavement is exposed.

Data acquisition unit 302 acquires data 202, 204, 206, 208, and 210 from data sources 102, 104, 106, 108, and 110 to produce a single stream of raw uncorrelated data. The data acquired and stored by AirScene™ is the key to predicting the future maintenance requirements of the pavement. Data correlation and Assembly Unit 502 takes this stream of raw uncorrelated data and produces a single stream of fully correlated and calculated data 602. Correlation involves identifying which data elements represent the same or similar items (e.g., with regard to aircraft weight and track) and eliminating duplicate entries.

It is important that data from two sources indicating the track of the same aircraft are not counted as two aircraft tracks, otherwise, aircraft tracking data might be doubled, indicating an increased wear on pavement which in reality does not exist. Calculations may include weight and wear calculations based upon aircraft weight (calculated from direct data, or inferred from aircraft type, cargo weight, fuel, and souls on board, or the like).

The Air Scene™ Data Warehouse 702 then stores this correlated and calculated data in a usable database. Workstations 902 connected to warehouse 702 may edit data or send queries 802 and receive results 804 which may be displayed 1002 in graphical, tabular, or visual form, illustrating pavement condition or other data.

The AirScene™ Pavement Management System can combine all the data sources into a single calculation of likely pavement condition. Historic data can also be accessed to make predictions about the future maintenance needs of the pavement. Also, scheduled airline operations data from sources such as OAG can be utilized to anticipate future airport operations for the purpose of calculating the future maintenance requirements of the pavement.

For example, a map of airport pavement may be shown, overlaid with aircraft tracks for a given time period. From this simple graphical illustration, a user can determine which sections of airport pavement receive the most use. Overlaying this image, color-coding may be used to show historic pavement condition and type data (physically obtained, or manually entered) showing initial pavement condition. Track data can then be used to "age" condition data, thus showing or highlighting potential "trouble" spots in red or other color.

Weather data can be used to further adjust such queries. In northern climates, where freeze/thaw cycles, as well as de-icing take a toll on pavement, weather factors can be added to previously mentioned factors to illustrate which sections of pavement are in the most need of service. In addition, from past behavior patterns, as well as manually entered future patterns, the image can be "aged" to show future conditions in terms of months or years into the future. From this data, an airport manager can then make a scientific evaluation of airport pavement conditions, and schedule pavement repair and/or replacement well ahead of actual pavement failure. The system also allows airport managers to schedule runway and taxiway closings well in advance of actual work, and even model how such closings will affect pavement wear on other taxiways and runways.

Note that the above scenario is by way of example only. Data may be displayed in other formats, and in addition, other types of useful data may be extracted from the AirScene™ Data Warehouse 702.

For example, the system can also be used as a pavement overload warning system. The basis for the warning system may comprise an electronic airport pavement map where the different load capacities of each section of pavement are shown. If an aircraft, whose actual weight was too high, rolled onto pavement (or was headed toward pavement) that was not designed for that weight, a warning would be issued to the airport operator. Physical inspection may be required to insure there was no damage and that no Foreign Objects or Debris (FOD) was created that may damage other aircraft.

In another alternative embodiment, a landing fee billing system may be implemented whose fees are based on the damage the aircraft is likely to be causing to the pavement. Aircraft known to place more stress on the pavement could be assessed higher landing fees to compensate the airport operator for the additional wear and tear. Aircraft weight can be readily determined by knowing aircraft type, souls on board, cargo weight, fuel weight, or even reported weight data (or even weight sensors embedded in pavement). Such a landing fee embodiment may be incorporated into the Rannoch Corporation Landing Fee system (described in the Patents and Pending Applications previously incorporated by reference) such that an aircraft owner can be automatically assessed a landing fee based upon aircraft weight, and billed accordingly.

The system of the present invention may also be used for tracking ground vehicles used to perform pavement inspection. These inspection vehicles can be equipped with a variety of inspection technologies including cameras, ultrasonic detectors, laser, and others. They are driven over the pavement and the instrumentation feeds pavement condition data to an on-board computer. This data is then correlated with the vehicle position to build a map of pavement condition, which must be uploaded to a traffic management system. The AirScene™ Pavement Management System can audit this process since the inspection vehicles location is known to the system. The time, date, and position of the inspection vehicle are automatically tracked by the system and automatically stored in the database, eliminating the need for manual data entry. Pavement inspection devices can even be embedded into various airport vehicles (e.g., baggage handling tractors, fuel trucks, catering trucks, snow removal, and/or other vehicles) such that pavement conditions are automatically monitored whenever airport personnel use these vehicles—without the intervention or even knowledge of the driver of such vehicles.

The AirScene™ Pavement Management System may also be used to audit the maintenance process of runway rubber removal. Excess rubber from accelerating aircraft tires builds up on the ends of the runways. This build-up can adversely affect the friction offered by the pavement surface as tested by a grip tester. Rubber may be removed with a variety of environmentally safe methods using vehicles or the like. The AirScene™ Pavement Monitoring System can track and record the time, date, and position of these vehicles to verify the affected pavement areas were cleaned.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A system for determining pavement wear, comprising:

electronic tracking system for automatically tracking actual continuous paths of real individual vehicles on the pavement to create vehicle path data;

means for automatically storing vehicle path data;

means for automatically calculating vehicle pavement wear based upon cumulative vehicle path data, by calculating cumulative wear to pavement areas caused by actual individual vehicle paths on the pavement; and a graphical display for displaying calculated vehicle pavement wear areas on a visual display as a graphical display of pavement wear overlaid on a map of the pavement.

2. The system of claim 1, further comprising:

means for receiving initial survey data to establish a baseline of pavement condition;

wherein said means for calculating pavement wear further calculates pavement conditions based upon initial survey data and calculated vehicle pavement wear data.

3. The system of claim 1, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and wherein said means for calculating pavement wear calculates vehicle pavement wear data based upon individual vehicle path and individual vehicle information.

4. The system of claim 1, wherein the means for calculating pavement wear based upon path of movement data determines pavement wear based upon where the vehicle was, how much it weighed, and how long it was on a particular section of pavement to determine wear on the pavement.

5. The system of claim 1, further comprising:

means for using historic vehicle tracking data to predict future maintenance needs of the pavement by determining where pavement wear due to vehicle traffic will occur.

6. The system of claim 1, wherein said means for calculating pavement wear based upon path of movement data further calculates future airport operations using scheduled airline operations data, to determine future maintenance requirements of the pavement.

7. A system for determining pavement wear comprising:

means for tracking continuous paths of individual vehicles on the pavement to create vehicle path data;

means for storing vehicle path data;

means for calculating vehicle pavement wear based upon cumulative vehicle path data, by calculating cumulative wear to pavement areas caused by individual vehicle paths on the pavement;

means for displaying calculated vehicle pavement wear areas on a visual display; and means for detecting environmental influences on pavement wear, including at least one of heat/cool cycles, freeze/thaw cycles, rainfall, sunlight, and temperature, wherein said means for calculating pavement wear further calculates pavement wear based upon environmental influences, and combines pavement wear based upon environmental influences with pavement wear caused by individual vehicle paths, and wherein said means for displaying calculated pavement wear areas on a visual display displays combined environmental and calculated vehicle pavement wear data.

8. The system of claim 7, further comprising:

means for receiving initial survey data to establish a baseline of pavement condition;

wherein said means for calculating pavement wear further calculates pavement conditions based upon initial survey data and calculated vehicle pavement wear data.

9. The system of claim 7, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load, fuel load, and passenger load; and future operational data, including flight schedules, increasing flight loads, and demand, and wherein said means for calculating pavement wear calculates vehicle pavement wear data based upon individual vehicle path and individual vehicle information.

10. The system of claim 7, wherein the means for calculating pavement wear based upon path of movement data determines pavement wear based upon where the vehicle was, how much it weighed, and how long it was on a particular section of pavement to determine wear on the pavement.

11. The system of claim 7, further comprising:

means for using historic vehicle tracking data to predict future maintenance needs of the pavement by determining where pavement wear due to vehicle traffic will occur.

12. The system of claim 7, wherein said means for calculating pavement wear based upon path of movement data further calculates future airport operations using scheduled airline operations data, to determine future maintenance requirements of the pavement.

13. A system for determining pavement wear, comprising:
means for tracking vehicle movement, including path of movement data for vehicles on the pavement;
means for storing path of movement data;
means for calculating pavement wear based upon path of movement data; and
means for displaying calculated pavement wear on a visual display,
wherein the means for tracking vehicle movement, including path of movement data for vehicles on the pavement comprises one or more of Multilateration (Mlat), Automatic Dependent Surveillance, Broadcast (ADS-B), Airport Surface Detection Equipment, Model X (ADS-X), Airport Surface Detection Equipment, Model B (ADS-B), Airport Movement-Area Safety System (AMASS), and Airport Surface Detection Equipment (ASDE), to determine at least one of type of aircraft or vehicle, type of operation (taxi, park, departure, or arrival), where the aircraft or vehicle operated, and also which runways, taxiways, and gates were used.

14. The system of claim 13, further comprising:
means for receiving initial survey data to establish a baseline of pavement condition;
wherein said means for calculating pavement wear further calculates pavement conditions based upon initial survey data and calculated vehicle pavement wear data.

15. The system of claim 13, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and
wherein said means for calculating pavement wear calculates vehicle pavement wear data based upon individual vehicle path and individual vehicle information.

16. The system of claim 13, wherein the means for calculating pavement wear based upon path of movement data determines pavement wear based upon where the vehicle was, how much it weighed, and how long it was on a particular section of pavement to determine wear on the pavement.

17. The system of claim 13, further comprising:
means for using historic vehicle tracking data to predict future maintenance needs of the pavement by determining where pavement wear due to vehicle traffic will occur.

18. The system of claim 13, wherein said means for calculating pavement wear based upon path of movement data further calculates future airport operations using scheduled airline operations data, to determine future maintenance requirements of the pavement.

19. A system for determining pavement wear, comprising:
means for tracking vehicle movement, including path of movement data for vehicles on the pavement;
means for storing path of movement data;
means for calculating pavement wear based upon path of movement data; and
means for displaying calculated pavement wear on a visual display,
wherein the means for tracking vehicle movement, including path of movement data for vehicles on the pavement uses data from the Aircraft Communication Addressing and Reporting System (ACARS), including at least one of weight of the aircraft, fuel, and cargo, time at the gate, time and position of wheels off the ground, and wheels on the ground.

20. The system of claim 19, further comprising:
means for receiving initial survey data to establish a baseline of pavement condition;
wherein said means for calculating pavement wear further calculates pavement conditions based upon initial survey data and calculated vehicle pavement wear data.

21. The system of claim 19, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load, fuel load, and passenger load; and future operational data, including flight schedules, increasing flight loads, and demand, and
wherein said means for calculating pavement wear calculates vehicle pavement wear data based upon individual vehicle path and individual vehicle information.

22. The system of claim 19, wherein the means for calculating pavement wear based upon path of movement data determines pavement wear based upon where the vehicle was, how much it weighed, and how long it was on a particular section of pavement to determine wear on the pavement.

23. The system of claim 19, further comprising:
means for using historic vehicle tracking data to predict future maintenance needs of the pavement by determining where pavement wear due to vehicle traffic will occur.

24. The system of claim 19, wherein said means for calculating pavement wear based upon path of movement data further calculates future airport operations using scheduled airline operations data, to determine future maintenance requirements of the pavement.

25. A system for determining pavement wear, comprising:
means for tracking vehicle movement, including path of movement data for vehicles on the pavement;
means for storing path of movement data;
means for calculating pavement wear based upon path of movement data;
means for displaying calculated pavement wear on a visual display; and
means for receiving weather information and operational data from one or more of the Digital Automatic Terminal Information Service (D-ATIS), Automatic Surface Observation System (ASOS), METerologicval Aviation Reguliere (METAR), and Terminal Area Forecast (TAF), for calculating pavement wear from life-cycle and weather factors.

26. The system of claim 25, further comprising:
means for receiving initial survey data to establish a baseline of pavement condition;
wherein said means for calculating pavement wear further calculates pavement conditions based upon initial survey data and calculated vehicle pavement wear data.

27. The system of claim 25, wherein the means for storing path of movement data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and wherein said means for calculating pavement wear calculates vehicle pavement wear data based upon individual vehicle path and individual vehicle information.

28. The system of claim 25, wherein the means for calculating pavement wear based upon path of movement data determines pavement wear based upon where the vehicle was, how much it weighed, and how long it was on a particular section of pavement to determine wear on the pavement.

29. The system of claim 25, further comprising:

means for using historic vehicle tracking data to predict future maintenance needs of the pavement by determining where pavement wear due to vehicle traffic will occur.

30. The system of claim 25, wherein said means for calculating pavement wear based upon path of movement data further calculates future airport operations using scheduled airline operations data, to determine future maintenance requirements of the pavement.

31. A system for determining pavement wear comprising:

means for tracking continuous paths of individual vehicles on the pavement to create vehicle path data;

means for storing vehicle path data;

means for calculating vehicle pavement wear based upon cumulative vehicle path data, by calculating cumulative wear to pavement areas caused by individual vehicle paths on the pavement;

means for displaying calculated vehicle pavement wear areas on a visual display; and means for determining and warning of pavement overload from individual vehicles, by receiving vehicle track data in real time, comparing vehicle type and weight with pavement in the vehicle track, and warning of pavement overload if an individual vehicle weight exceeds pavement capacity in the vehicle track.

32. The system of claim 31, further comprising:

means for receiving initial survey data to establish a baseline of pavement condition;

wherein said means for calculating pavement wear further calculates pavement conditions based upon initial survey data and calculated vehicle pavement wear data.

33. The system of claim 31, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and wherein said means for calculating pavement wear calculates vehicle pavement wear data based upon individual vehicle path and individual vehicle information.

34. The system of claim 31, wherein the means for calculating pavement wear based upon path of movement data determines pavement wear based upon where the vehicle was, how much it weighed, and how long it was on a particular section of pavement to determine wear on the pavement.

35. The system of claim 31, further comprising:

means for using historic vehicle tracking data to predict future maintenance needs of the pavement by determining where pavement wear due to vehicle traffic will occur.

36. The system of claim 31, wherein said means for calculating pavement wear based upon path of movement data further calculates future airport operations using scheduled airline operations data, to determine future maintenance requirements of the pavement.

37. A system for determining pavement wear comprising:

means for tracking continuous paths of individual vehicles on the pavement to create vehicle path data;

means for storing vehicle path data;

means for calculating vehicle pavement wear based upon cumulative vehicle path data, by calculating cumulative wear to pavement areas caused by individual vehicle paths on the pavement;

means for displaying calculated vehicle pavement wear areas on a visual display; and a landing fee billing system, for calculating landing fees based upon vehicle weight data and vehicle track data such that vehicle landing fees are calculated based on damage a vehicle is likely to be causing to the pavement.

38. The system of claim 37, further comprising:

means for receiving initial survey data to establish a baseline of pavement condition;

wherein said means for calculating pavement wear further calculates pavement conditions based upon initial survey data and calculated vehicle pavement wear data.

39. The system of claim 37, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and wherein said means for calculating pavement wear calculates vehicle pavement wear data based upon individual vehicle path and individual vehicle information.

40. The system of claim 37, wherein the means for calculating pavement wear based upon path of movement data determines pavement wear based upon where the vehicle was, how much it weighed, and how long it was on a particular section of pavement to determine wear on the pavement.

41. The system of claim 37, further comprising:

means for using historic vehicle tracking data to predict future maintenance needs of the pavement by determining where pavement wear due to vehicle traffic will occur.

42. The system of claim 37, wherein said means for calculating pavement wear based upon path of movement data further calculates future airport operations using scheduled airline operations data, to determine future maintenance requirements of the pavement.

43. A system for determining pavement wear comprising:

means for tracking continuous paths of individual vehicles on the pavement to create vehicle path data;

means for storing vehicle path data;

means for calculating vehicle pavement wear based upon cumulative vehicle path data, by calculating cumulative wear to pavement areas caused by individual vehicle paths on the pavement;

means for displaying calculated vehicle pavement wear areas on a visual display;

means for tracking ground vehicles used to perform pavement inspection; and means for receiving pavement inspection data from ground vehicles and correlating pavement inspection data with ground vehicle tracking data to determine pavement condition.

44. The system of claim 43, further comprising:

means for receiving initial survey data to establish a baseline of pavement condition;

wherein said means for calculating pavement wear further calculates pavement conditions based upon initial survey data and calculated vehicle pavement wear data.

45. The system of claim 43, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load , fuel load, and passenger load; and future operational data, including flight schedules, increasing flight loads, and demand, and wherein said means for calculating pavement wear calculates vehicle pavement wear data based upon individual vehicle path and individual vehicle information.

46. The system of claim 43, wherein the means for calculating pavement wear based upon path of movement data determines pavement wear based upon where the vehicle was, how much it weighed, and how long it was on a particular section of pavement to determine wear on the pavement.

47. The system of claim 43, further comprising:

means for using historic vehicle tracking data to predict future maintenance needs of the pavement by determining where pavement wear due to vehicle traffic will occur.

48. The system of claim 43, wherein said means for calculating pavement wear based upon path of movement data further calculates future airport operations using scheduled airline operations data, to determine future maintenance requirements of the pavement.

49. A system for determining pavement wear comprising:

means for tracking continuous paths of individual vehicles on the pavement to create vehicle path data;

means for storing vehicle path data;

means for calculating vehicle pavement wear based upon cumulative vehicle path data, by calculating cumulative wear to pavement areas caused by individual vehicle paths on the pavement;

means for displaying calculated vehicle pavement wear areas on a visual display; and means for monitoring maintenance processes of runway rubber removal including means for tracking and recording time, date, and position of runway rubber removal vehicles to verify affected pavement areas are cleaned.

50. The system of claim 49, further comprising:

means for receiving initial survey data to establish a baseline of pavement condition;

wherein said means for calculating pavement wear further calculates pavement conditions based upon initial survey data and calculated vehicle pavement wear data.

51. The system of claim 49, wherein the means for storing vehicle path data further includes a repository for individual vehicle information acquired from a plurality of data sources, including at least one of aircraft or vehicle type, including wheel layout, weight, and vehicle-specific parameters; aircraft or vehicle location including ground track, position, and gate used; aircraft or vehicle dynamics including velocity, acceleration, take off, and touchdown, aircraft or vehicle actual weight, including cargo load, fuel load, and passenger load; and future operational data, including flight schedules, increasing flight loads, and demand, and wherein said means for calculating pavement wear calculates vehicle pavement wear data based upon individual vehicle path and individual vehicle information.

52. The system of claim 49, wherein the means for calculating pavement wear based upon path of movement data determines pavement wear based upon where the vehicle was, how much it weighed, and how long it was on a particular section of pavement to determine wear on the pavement.

53. The system of claim 49, further comprising:

means for using historic vehicle tracking data to predict future maintenance needs of the pavement by determining where pavement wear due to vehicle traffic will occur.

54. The system of claim 49, wherein said means for calculating pavement wear based upon path of movement data further calculates future airport operations using scheduled airline operations data, to determine future maintenance requirements of the pavement.

* * * * *